US006763989B2

(12) United States Patent
Wang

(10) Patent No.: US 6,763,989 B2
(45) Date of Patent: Jul. 20, 2004

(54) SLIDABLE NOZZLE FOR POWER NAILERS

(76) Inventor: Kuan Lin Wang, 11F-2, No. 43, Chai-I Street, Taichung City (TW)

( * ) Notice: Subject to any disclaimer, the term of this patent is extended or adjusted under 35 U.S.C. 154(b) by 265 days.

(21) Appl. No.: 09/943,293

(22) Filed: Aug. 31, 2001

(65) Prior Publication Data

US 2003/0042285 A1 Mar. 6, 2003

(51) Int. Cl.[7] ..... B25C 5/02
(52) U.S. Cl. ..... 227/123; 227/127; 227/109
(58) Field of Search ..... 227/123, 127, 227/109

(56) References Cited

U.S. PATENT DOCUMENTS 3,853,257 A * 12/1974 Perkins ..... 227/123
4,139,137 A * 2/1979 Gupta ..... 227/110
4,436,236 A * 3/1984 Jobe ..... 227/123
4,467,952 A * 8/1984 Morrell, Jr. ..... 227/120
4,549,681 A * 10/1985 Yamamoto et al. ..... 227/123
4,641,772 A * 2/1987 Skuthan ..... 227/123
5,642,849 A * 7/1997 Chen ..... 227/123
5,649,660 A * 7/1997 Akiba et al. ..... 227/123
6,056,182 A * 5/2000 Chen ..... 227/123
6,076,722 A * 6/2000 Huang ..... 227/123
6,318,617 B1 * 11/2001 Cheng ..... 227/109
6,318,618 B1 * 11/2001 Jen ..... 227/123
6,325,268 B1 * 12/2001 Liang ..... 227/123

* cited by examiner

*Primary Examiner*—John Sipos
*Assistant Examiner*—Louis Tran
(74) *Attorney, Agent, or Firm*—Charles E. Baxley

(57) ABSTRACT

A nozzle assembly for nailers includes a magazine connected to a body of the nailer and a base plate is connected to an end of the magazine. A nozzle has two grooves with which the two sides of the base plate are movably engaged. A plurality of nail guide holes are defined through the nozzle and communicate with openings defined in the base plate and slots defined in a side of the magazine so that nails engaged with the slots are sent to the nail guide holes to be ejected. Two hooks extend from the nozzle and a cap is mounted on the nozzle by engaging the two hooks with two apertures defined through the cap. Pins extend through the nozzle and are engaged with the base plate.

2 Claims, 4 Drawing Sheets

SLIDABLE NOZZLE FOR POWER NAILERS

FIELD OF THE INVENTION

The present invention relates to a nozzle which is slidably connected to the base of the nailer so that the nozzle can be conveniently replaced according to needs.

BACKGROUND OF THE INVENTION

A conventional power nailer generally has a nozzle connected to a base of a nailer and a magazine for receiving nails is connected to the nailer. The magazine provides nails and the nails are ejected out from the nozzle. The conventional way to connect the nozzle to the base is by bolting the nozzle on the base so that the nozzle is fixed on the base. However, the requirements of the size of the nozzles could be changed because the length of the nails so that the conventional way that fixes the nozzle on the base is not convenient for the users to change a new nozzle.

SUMMARY OF THE INVENTION

In accordance with one aspect of the present invention, there is provided a nozzle assembly for nailers and comprises a magazine connected to a body of the nailer and a base plate is connected to an end of the magazine. A plurality of slots are defined in a side of the magazine and a plurality of openings are defined through the base plate and communicate with the slots. A nozzle is movably engaged with the base plate. A plurality of nail guide holes are defined through the nozzle and communicate with the openings. Two hooks extend from the nozzle. A cap is mounted on the nozzle and has two apertures through which the hooks are engaged.

The primary object of the present invention is to provide a nozzle assembly for nailers wherein the nozzle is slidably mounted to the base plate so that the nozzle can be conveniently replaced according to practical needs.

The present invention will become more obvious from the following description when taken in connection with the accompanying drawings which show, for purposes of illustration only, preferred embodiments in accordance with the present invention.

DETAILED DESCRIPTION OF THE PREFERRED EMBODIMENTS

Figure 1:
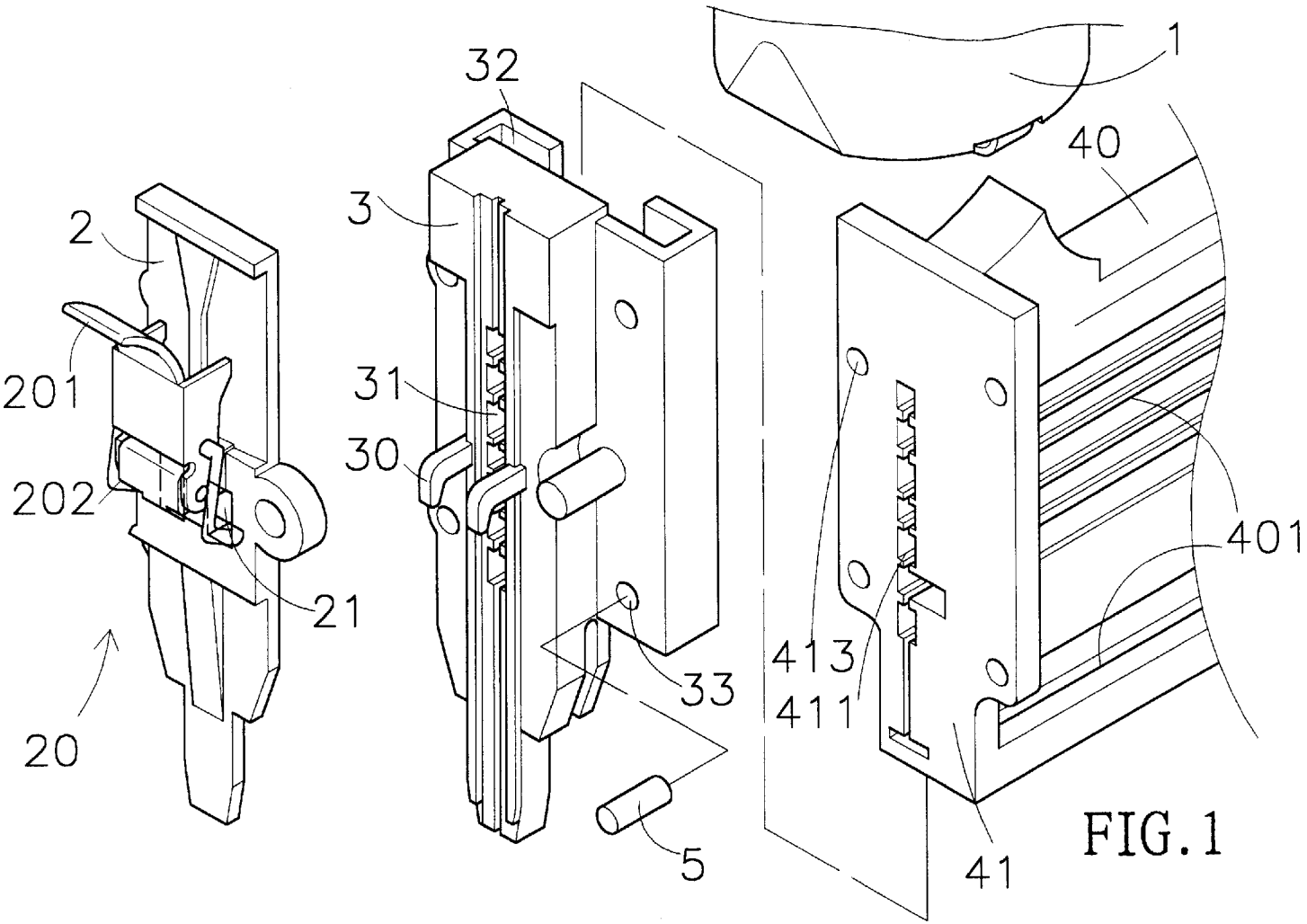
FIG. 1 is a perspective view to show the nozzle assembly of the present invention.
Figure 2:
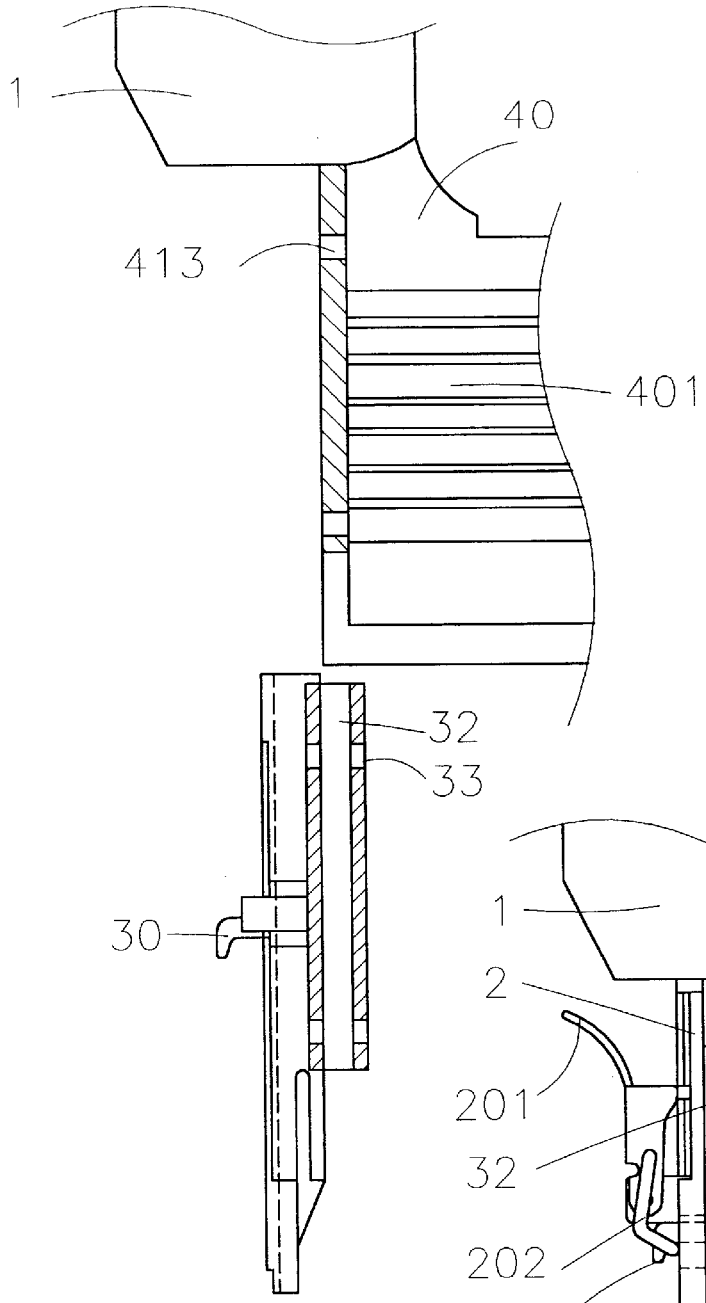
FIG. 2 is a cross sectional view to show the nozzle is to be slidably mounted on the base plate of the magazine.
Figure 3:
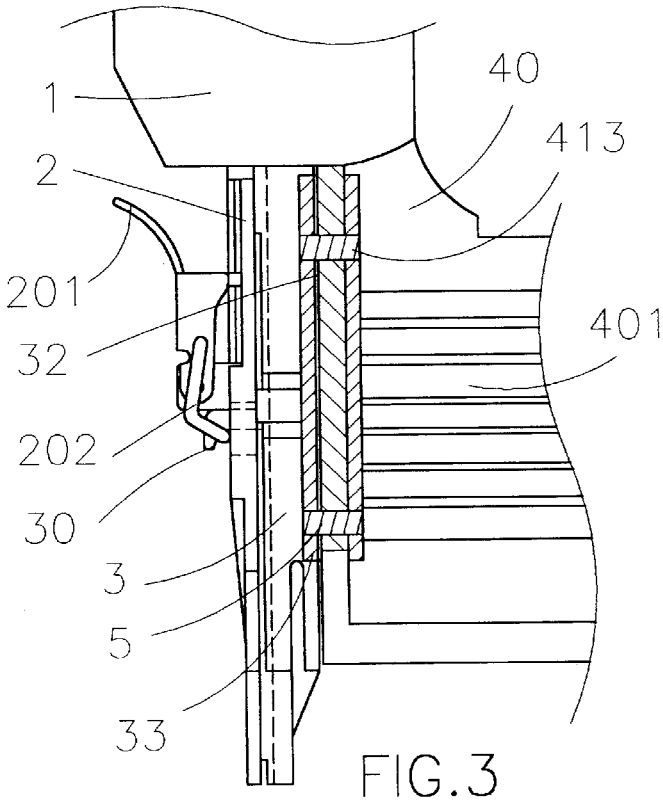
FIG. 3 is a cross sectional view to show the nozzle is mounted on the base plate of the magazine.

Referring to FIGS. 1 to 3, the nozzle assembly for nailers of the present invention comprises a magazine 40 which is connected to a body of the nailer 1 and a base plate 41 is connected to an end of the magazine 40. A plurality of slots 401 are defined in a side of the magazine 40 so that nails (not shown) are engaged with the slots 401. A plurality of openings 411 are defined through the base plate 41 and communicate with the slots 401. Four holes 413 are defined through the base plate 41.

Figure 4:
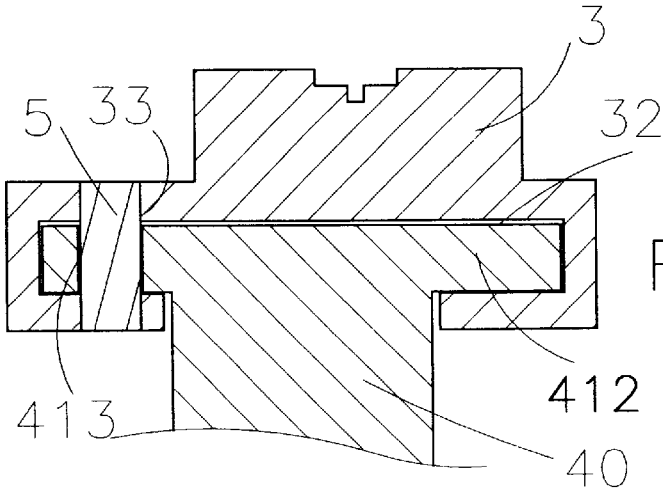
FIG. 4 is a cross sectional view to show the engagement of the base plate and the nozzle.

A nozzle 3 has two wings on a bottom thereof and each wing has a groove 32 with which the two sides of the base plate 41 are movably engaged. A plurality of nail guide holes 31 are defined through the nozzle 3 and communicate with the openings 411. Two hooks 30 extend from the nozzle 3. Four holes 33 are defined through the wings and pins 5 extend through the holes 33 and are engaged with the holes 413 to connect the nozzle 3 on the base plate 41 as shown in FIG. 4.

A cap 2 is mounted on the nozzle 3 and has two apertures 21 through which the hooks 30 are engaged. A quick release means 20 is connected on the cap 2 and includes a clamp means 202 and a lever 201 so that the cap 2 is securely connected to the nozzle 3 by the use of the quick release means 20.

Figure 5:
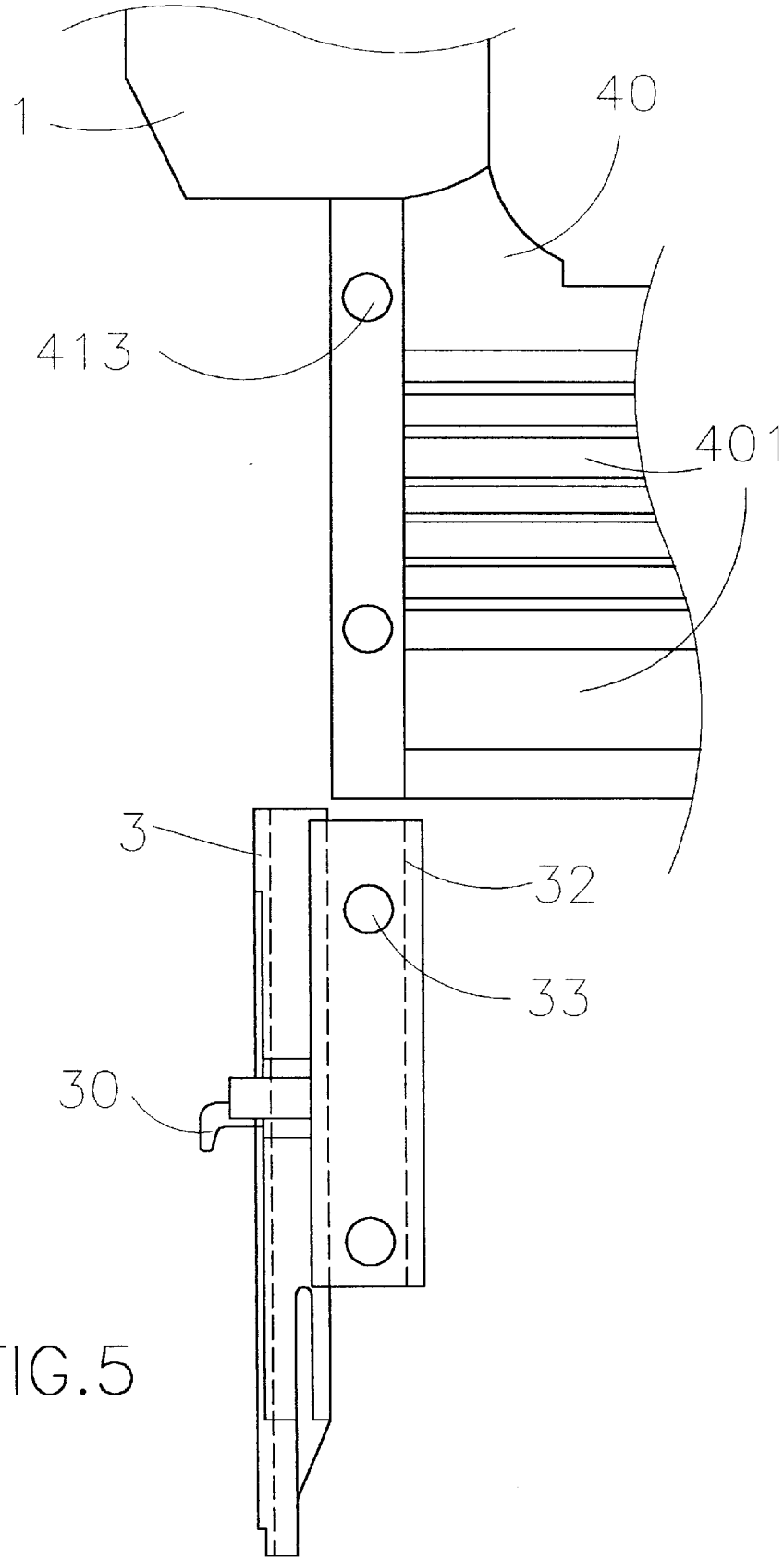
FIG. 5 is a cross sectional view to show another embodiment of the nozzle to be slidably mounted on the base plate of the magazine.

FIG. 5 shows that the positions of the holes 413 in the base plate 41 and the holes 33 in the nozzle 3 are located on sides of the base plate 41 and the nozzle 3 so that the connection of the base plate 41 and the nozzle 3 can be connected by extending pins 5 through the holes 33 and 413.

Figure 7:
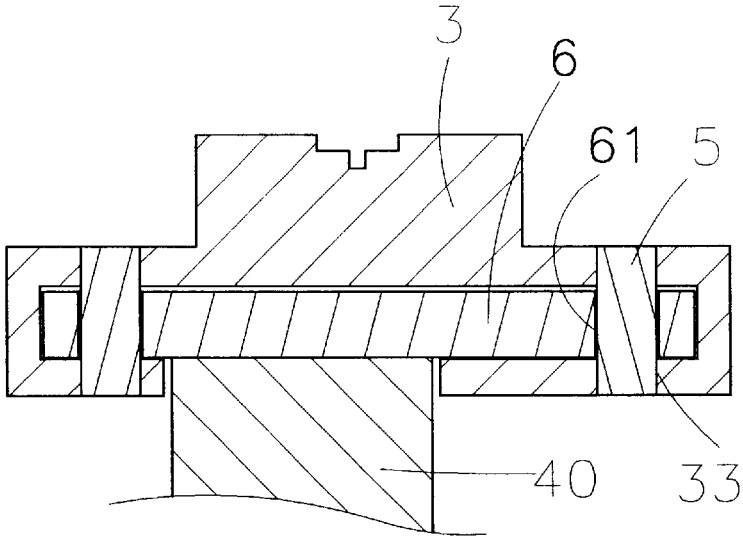
FIG. 7 is a cross sectional view to show yet another embodiment of the engagement of the base plate and the nozzle.
Figure 6:
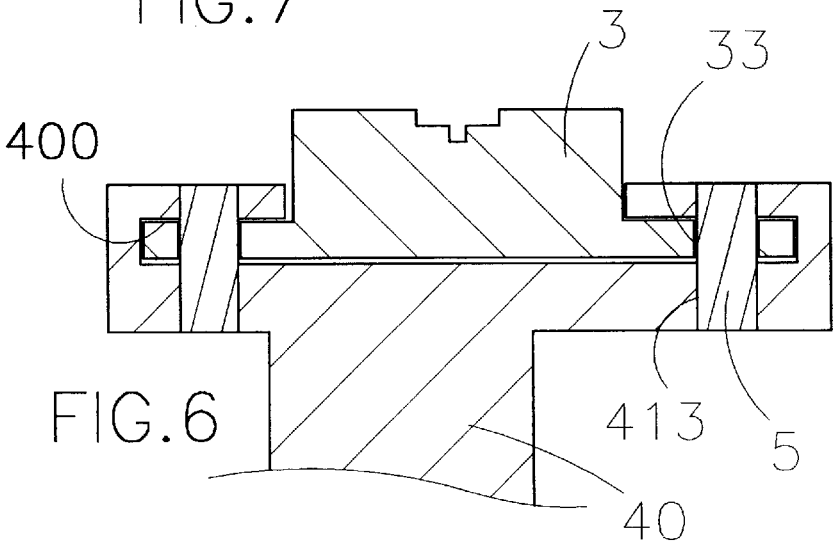
FIG. 6 is a cross sectional view to show another embodiment of the engagement of the base plate and the nozzle.

FIG. 6 shows that the base plate 41 has two grooves 400 defined therein and the nozzle 3 is slidably engaged with the two grooves 400. FIG. 7 shows that the base plate 6 and the magazine 40 are two individual parts and the magazine 40 is connected to the base plate 6 by a proper way. Pins 5 extend through holes 33 in the wings of the nozzle 3 and the holes 61 in the base plate 6.

The nozzle 3 in the nozzle assembly of the present invention can be conveniently replaced according to the different lengths of the nails.

While we have shown and described the embodiment in accordance with the present invention, it should be clear to those skilled in the art that further embodiments may be made without departing from the scope of the present invention.

What is claimed is:

1. A nozzle assembly for nailers, comprising:

a magazine adapted to be connected to a body of the nailer and a base plate connected to an end of said magazine, a plurality of slots defined in a side of said magazine and a plurality of openings defined through said base plate and communicating with said slots;

a nozzle having two wings and each wing having a groove in which one of two sides of said base plate is slidably received, pins extending through said wings and engaged with said base plate, a plurality of nail guide holes defined through said nozzle and communicating with said openings, two hooks extending from said nozzle, and a cap mounted on said nozzle and having two apertures through which said hooks are engaged.

2. A nozzle assembly for nailers, comprising:

a magazine adapted to be connected to a body of the nailer and a base plate connected to an end of said magazine, said base plate having two grooves defined therein, a plurality of slots defined in a side of said magazine and a plurality of openings defined through said base plate and communicating with said slots;

a nozzle slidably engaged with said two grooves of said base plate, a plurality of nail guide holes defined through said nozzle and communicating with said openings, two hooks extending from said nozzle, and a cap mounted on said nozzle and having two apertures through which said hooks are engaged.

* * * * *